US008926290B2

(12) United States Patent
Hart et al.

(10) Patent No.: US 8,926,290 B2
(45) Date of Patent: Jan. 6, 2015

(54) IMPELLER TUBE ASSEMBLY

(75) Inventors: Andrew Clifford Hart, Mauldin, SC (US); Tushar Sharadchandra Desai, Greer, SC (US); John Herbert Dimmick, III, Greenville, SC (US); Matthew Paul Forcier, Manchester, CT (US); Chunlian Han, Greenville, SC (US); Charles Alexander Smith, Greenville, SC (US)

(73) Assignee: General Electric Company, Schenectady, NY (US)

( * ) Notice: Subject to any disclaimer, the term of this patent is extended or adjusted under 35 U.S.C. 154(b) by 509 days.

(21) Appl. No.: 13/343,519

(22) Filed: Jan. 4, 2012

(65) Prior Publication Data

US 2013/0170998 A1 Jul. 4, 2013

(51) Int. Cl.
*F01D 25/04* (2006.01)

(52) U.S. Cl.
USPC ..... 416/248

(58) Field of Classification Search
CPC ..... F01D 5/084; F01D 5/10
USPC ..... 416/248, 500
See application file for complete search history.

(56) References Cited

U.S. PATENT DOCUMENTS

| | | | | |
|---|---|---|---|---|
| 4,142,843 | A * | 3/1979 | Kish | 417/313 |
| 4,314,486 | A * | 2/1982 | Hellwig | 74/573.1 |
| 5,267,832 | A | 12/1993 | Johnson et al. | |
| 5,472,313 | A | 12/1995 | Quinomes et al. | |
| 5,526,640 | A | 6/1996 | Brooks et al. | |
| 5,570,580 | A | 11/1996 | Mains | |
| 6,027,304 | A | 2/2000 | Arar et al. | |
| 6,283,712 | B1 | 9/2001 | Dziech et al. | |
| 6,334,755 | B1 | 1/2002 | Coudray et al. | |
| 6,648,592 | B2 | 11/2003 | Escure et al. | |
| 7,159,402 | B2 | 1/2007 | Hein et al. | |
| 7,552,590 | B2 | 6/2009 | Drevs et al. | |
| 7,828,514 | B2 | 11/2010 | Kutz | |
| 7,870,742 | B2 | 1/2011 | Lee et al. | |
| 2009/0282834 | A1 | 11/2009 | Hein | |
| 2010/0266387 | A1 | 10/2010 | Bintz et al. | |
| 2010/0266401 | A1 | 10/2010 | Bintz et al. | |

FOREIGN PATENT DOCUMENTS

| | | | |
|---|---|---|---|
| EP | 1457640 | A2 | 9/2004 |
| EP | 1750012 | A1 | 2/2007 |
| EP | 102008024146 | A2 | 11/2009 |

* cited by examiner

*Primary Examiner* — Liam McDowell
(74) *Attorney, Agent, or Firm* — Cantor Colburn LLP

(57) ABSTRACT

An attenuation bracket is provided and includes an annular body having an annular attenuation arm defining first through-holes and an annular base defining second through-holes. A cross-section of the attenuation arm includes a flange, a connector opposite the flange and a curvilinear section extending between the flange and the connector. A cross-section of the base includes a first side corresponding with the flange and a second side opposite the first side and corresponding with the connector. The second side is connectable with the connector such that each of the first through-holes is defined in positional alignment with a corresponding one of the second through-holes.

20 Claims, 4 Drawing Sheets

IMPELLER TUBE ASSEMBLY

BACKGROUND OF THE INVENTION

The subject matter disclosed herein relates to an impeller tube assembly and to a compressor including an impeller tube assembly having an attenuation bracket.

In modern turbomachines, such as gas engine turbines, it is often necessary to direct fluid flow along an impeller component from an initial radial position relative to a rotational axis to a secondary radial position. This is sometimes achieved with an impeller tube assembly that often includes a support bracket, an impeller tube and a damper tube. The support bracket holds the tubes to a compressor wheel such that the tubes provide a fluid flow pathway in the radial dimension and the damper tube serves to dampen impeller tube vibration during turbomachine operation.

For such assemblies to operate properly, the impeller tube and the damper tube must be retained to and centered by the bracket under very high rotational speeds. Both tubes must also be positively retained on low speed operation so that they do not rattle, which would create noise and lead to wear. Many concepts have been developed for tube retention into the bracket but most designs require an additional retention feature to hold the parts in place during low speed operation. These parts can be misassembled and often do not prevent the tubes from clanking or wearing.

BRIEF DESCRIPTION OF THE INVENTION

An impeller tube assembly is provided and includes an annular body having an annular attenuation arm defining first through-holes and an annular base defining second through-holes. A cross-section of the attenuation arm includes a flange, a connector opposite the flange and a curvilinear section extending between the flange and the connector. A cross-section of the base includes a first side corresponding with the flange and a second side opposite the first side and corresponding with the connector. The second side is attached with the connector such that each of the first through-holes is defined in positional alignment with a corresponding one of the second through-holes.

According to another aspect of the invention, a turbomachine component is provided and includes a wheel rotatable about a rotor axis and having a body and opposite wheel faces thereof, a plurality of tubes oriented in a radial dimension relative to the rotor axis and arranged in an annular array about the rotor axis and an attenuation bracket coupled to one of the faces of the wheel to radially support the plurality of the tubes in rotational and non-rotational modes. The attenuation bracket includes an annular body having an annular attenuation arm defining first through-holes and an annular base defining second through-holes, the attenuation arm being connectable with the base such that each of the first through-holes is defined in positional alignment with a corresponding one of the second through-holes, and each of the plurality of the tubes being extendable through one of the first through-holes and the corresponding one of the second through-holes.

According to yet another aspect of the invention, a turbomachine component is provided and includes a wheel rotatable about a rotor axis and having a body and opposite wheel faces thereof, a plurality of tubes oriented in a radial dimension relative to the rotor axis and arranged in an annular array about the rotor axis and an attenuation bracket coupled to an inner diameter of one of the wheel faces of the wheel to radially support the plurality of the tubes in rotational and non-rotational modes, the attenuation bracket including an annular body having an annular attenuation arm defining first cylindrical through-holes and an annular base defining second frusto-conical through-holes, the attenuation arm being connectable with the base such that each of the first through-holes is defined in positional alignment with a corresponding one of the second through-holes, and each of the plurality of the tubes being mechanically bonded to the attenuation arm and radially, outwardly extendable through one of the first through-holes and the corresponding one of the second through-holes.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 2:
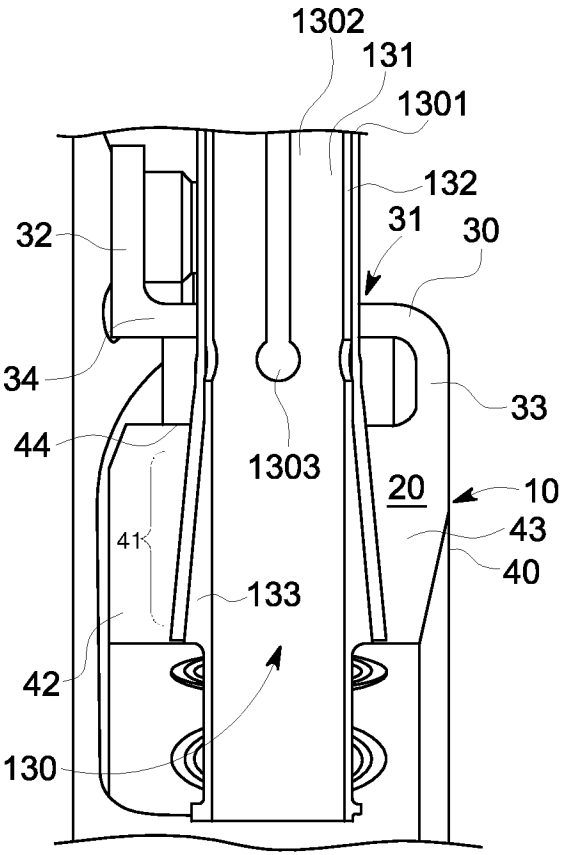
FIG. 2 is a side view of the attenuation bracket of FIG. 1.
Figure 1:
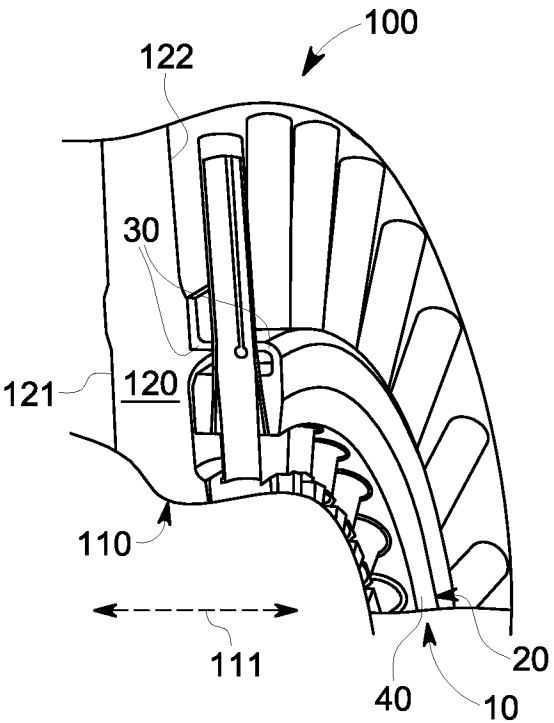
FIG. 1 is a perspective view of an attenuation bracket in accordance with embodiments.

With reference to FIGS. 1 and 2, an attenuation bracket 10 is provided and includes an annular body 20 having an annular attenuation arm 30 and an annular base 40. The annular attenuation arm 30 is formed to define an annular array of first through-holes 31 and the annular base 40 is formed to define an annular array of second through-holes 41. A cross-section of the attenuation arm 30 includes a flange 32 at a first end thereof, a connector 33 opposite the flange 32 at a second end thereof and a curvilinear section 34, which extends between the flange 32 and the connector 33. In accordance with embodiments, the flange 32 and the connector 33 may be oriented to extend radially outwardly and the curvilinear section 34 may have an outwardly curved end connected to the flange 32, an inwardly curved end connected to the connector 33 and an axial section extending between the curved ends.

A cross-section of the base 40 includes a first side 42 corresponding in position with the flange 32, a second side 43 opposite the first side 42 and corresponding in position with the connector 33 and a surface 44 extending between the first side 42 and the second side 43. The second side 43 is connectable with the connector 33 such that the surface 44 is displaced from the curvilinear section 34 and such that each of the first through-holes 31 is defined in positional alignment with a corresponding one of the second through-holes 41.

The attenuation bracket 10 may be installed within a turbomachine or a turbomachine component, such as a compressor 100 of a gas turbine engine at, for example, a $10^{th}$ stage thereof. The compressor 100 may include a wheel 110, a plurality of tubes 130 and the attenuation bracket 10. The wheel 110 is rotatable about a rotor axis 111 and has a body 120 with a forward face 121 and an opposite aft face 122. The plurality of the tubes 130 is provided with each individual tube 131 being oriented in a radial dimension relative to the rotor axis 111 and the plurality of the tubes 130 being arranged in an annular array about the rotor axis 111. The attenuation bracket 10 is coupled to one of the wheel faces, such as the aft face 122, for example, to radially support the plurality of the tubes 130 in rotational and non-rotational modes. That is, the attenuation bracket 10 is configured to radially, circumferentially and axially secure each individual tube 131 when the wheel 110 is rotating at top speed, when the wheel 110 is rotating at partial load speed and when the wheel 110 is not rotating.

Figure 8:
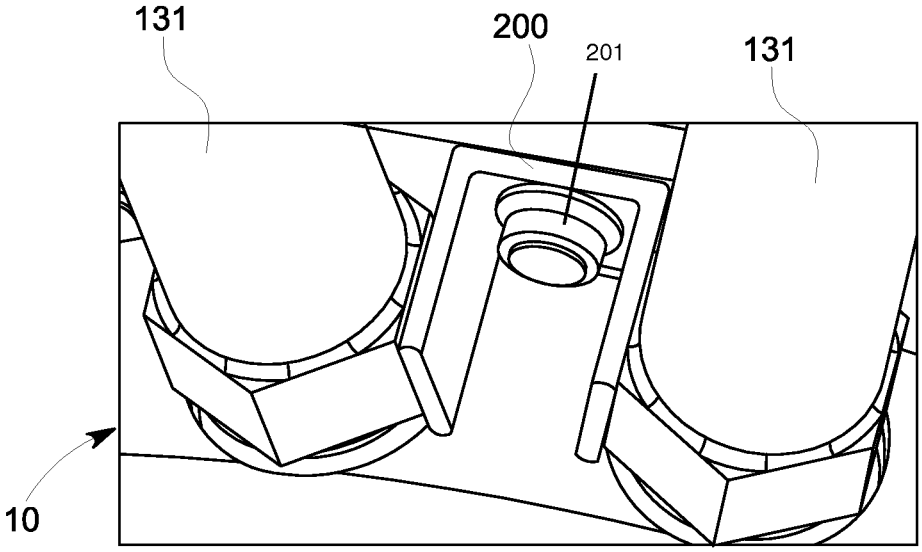
FIG. 8 is a perspective view of an anti-rotation feature.

In accordance with embodiments, the attenuation bracket 10 may be fastened to an inner diameter of the aft face 122 of the wheel 110 by, for example, a bolt and nut fastening element extending through the flange 32 of the attenuation arm 30 in a radial or axial dimension with the first side 42 of the base 40 disposed adjacent to the aft face 122 (see bolt 201 in FIG. 8). The annularity of the attenuation bracket 10 limits deformation thereof and permits differential thermal growth between the wheel 110 and the attenuation bracket 10. Thus, even if the wheel 110 and the attenuation bracket 10 experience differential thermal growth, the radial orientation of each individual tube 131 of the plurality of the tubes 130 is maintained such that each individual tube 131 extends radially outwardly from the attenuation bracket 10 during rotational and non-rotational modes.

The differential thermal growth between the wheel 110 and the attenuation bracket 10 is permitted by the attenuation bracket 10 being fastened to the wheel 110 at the flange 32 of the attenuation arm 30 and the base 40 being unfastened to the wheel 110. With this construction, relative thermal growth of the wheel 110 and the attenuation bracket 10 is manifested as a relative displacement of the base 40 and the wheel 110 and absorbed by the attenuation bracket 10 and, more particularly, the relative flexibility of at least the curvilinear section 34 of the attenuation arm 30.

The first through-holes 31 may be cylindrical and the second through-holes 41 may be frusto-conical. In these embodiments, a diameter of each of the second through-holes 41 is similar to that of the first through-holes 31 at the surface 44 of the base 40. The diameter of the second through-holes 41 increases with decreasing radial distance at an angle of about 3-20 degrees (as measured with respect to a radial line or dimension), inclusively, or more particularly about 10 or 16 degrees. Similarly, each individual tube 131 has a cylindrical section 132 and a tapered section 133 having an angle that complements the angle of the second through-holes 41. With this construction, each individual tube 131 is inserted through pairs of the second and first through-holes 41, 31 with the cylindrical section 132 leading such that the tapered section 133 registers with sidewalls of the second through-holes 41.

Each individual tube 131 of the plurality of the tubes 130 includes an outer tube 1301 and an inner tube 1302. The outer tube 1301 may be generally cylindrical in correspondence with the cylindrical section 132 and may be tapered in correspondence with the tapered section 133. The inner tube 1302 is sized to fit within the outer tube 1301 and may be generally cylindrical in correspondence with the cylindrical section 132 and tapered in correspondence with the tapered section 133. The inner tube 1302 may also include damping features 1303. The damping features 1303 may be formed with a keyhole shape that is configured to allow the inner tube 1302 to dampen or otherwise limit a vibration of at least the outer tube 1301. When assembled together the outer tube 1301 and the iner tube 1302 form an impeller tube assembly.

Each of the individual tubes 131 may be loaded with an initial compressive load to generate a temporary bond between outer surfaces of the respective tapered sections 133 and the sidewalls of the second through-holes 41. Thereafter, the wheel 110 is rotated about the rotor axis 111 at high speeds, such as speeds associated with normal compressor and gas turbine engine operations. The outer surfaces of the respective tapered sections 133 and the sidewalls of the second through-holes 41 thereby form mechanical bonds such that the individual tubes 131 remain in place when the wheel 110 rotates and when the wheel 110 slows down and ultimately stops rotating. In particular, for an individual tube 131 at the tapered section 133, an outer surface of the inner tube 1302 may form a mechanical bond with an inner surface of the outer tube 1301 and an outer surface of the outer tube 1301 may form a mechanical bond with an inner surface of the corresponding second through-hole 41. The mechanical bonds referred to herein may be frictional shear bonds that result when two conical features are forced together along a common shallow angle.

The conical attachment, as described above, eliminates or substantially reduces a need for additional parts and presents little to no local stress concentrations. Indeed, due to the relatively shallow angle (i.e., about 3-20 degrees, inclusively) of the tapered section 133, the outer tube 1301 and the inner tube 1302 may have large, gradual fillet radii with low stress concentrations.

Figure 3:
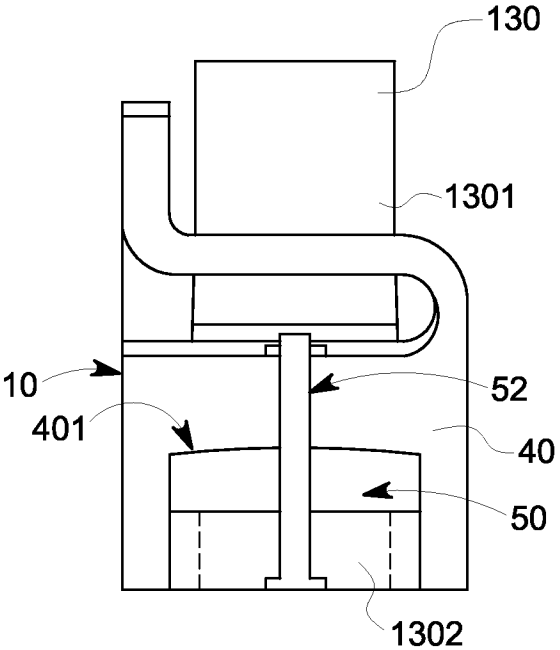
FIG. 3 is a side view of the attenuation bracket in accordance with alternate embodiments.

In accordance with alternative embodiments and, with reference to FIG. 3, the base 40 of the attenuation bracket 10 may be formed to define an annular recess 401. As shown in FIG. 3, the attenuation bracket 10 may further include an outer tube base 50 of the outer tube 1301, which is held in the annular recess by mechanical interference between the inner tube 1302 and bolt and nut combination 52.

Figure 4:
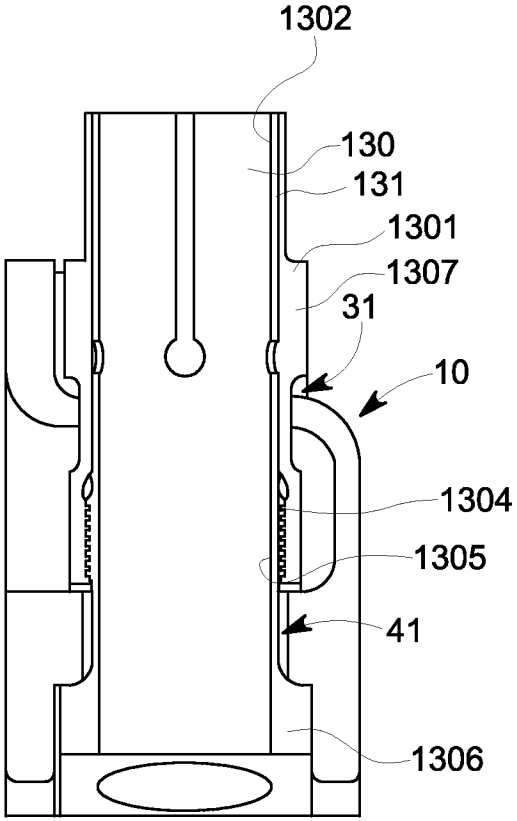
FIG. 4 is a side view of the attenuation bracket in accordance with alternate embodiments.

In accordance with alternative embodiments and, with reference to FIG. 4, the first through-holes 31 and the second through-holes 41 may be cylindrical. In such cases, the outer tube 1301 may have threading 1304 formed on the inner surface thereof and the inner tube 1302 may have complementary threading 1305 formed on the outer surface thereof such that the inner tube 1302 can be threadably engaged with the outer tube 1301. In addition, the inner tube 1302 may include an inner protrusion 1306 such that each of the individual tubes 131 may be radially secured once the inner and the outer tubes are 1302, 1301 are threadably engaged. The outer tube 1301 may include a wrenching feature 1307 for torqueing the outer tube 1301 and the inner tube 1302 together.

Figure 5:
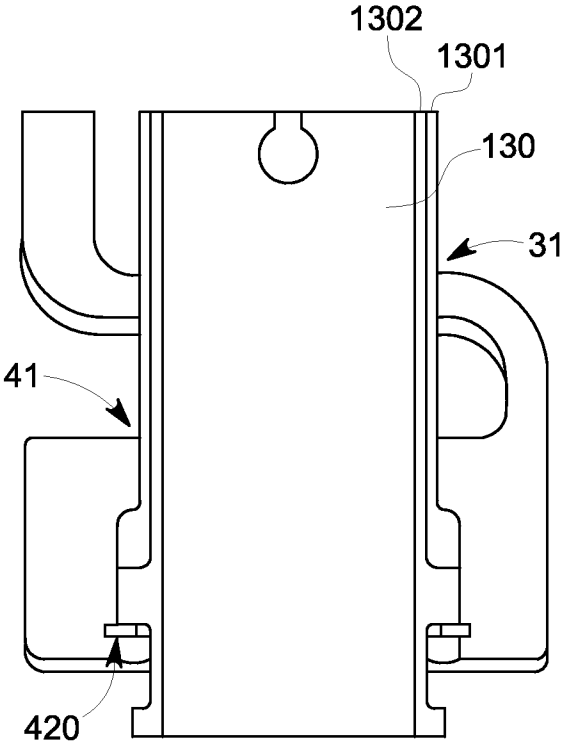
FIG. 5 is a side view of the attenuation bracket in accordance with alternate embodiments.

In accordance with alternative embodiments and, with reference to FIG. 5, the first through-holes 31 may be cylindrical and the second through-holes 41 may be partially cylindrical and partially pear shaped and include a notch defined therein. In such cases, the outer tube 1301 and the inner tube 1302 may each have features that complement the partial cylindrical and partial pear-shape of the second through-holes 41. In addition, the attenuation bracket 10 may further include a compressible ring feature 420 to fit within the notch such that each of the individual tubes 131 may be radially secured.

Figure 6:
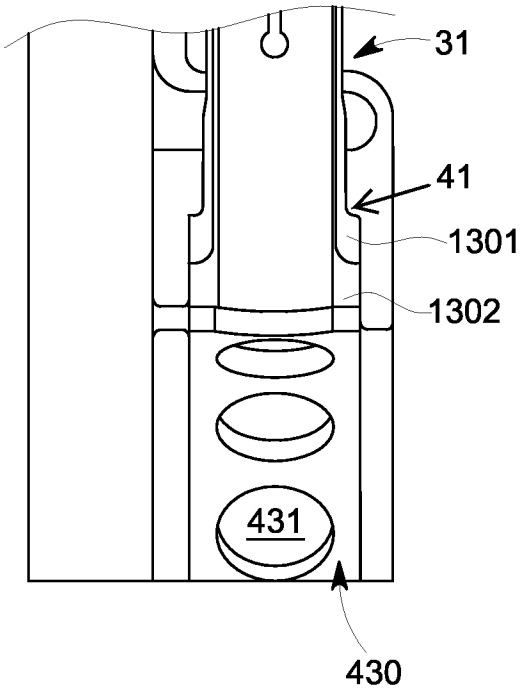
FIG. 6 is a side view of the attenuation bracket in accordance with alternate embodiments.
Figure 7:
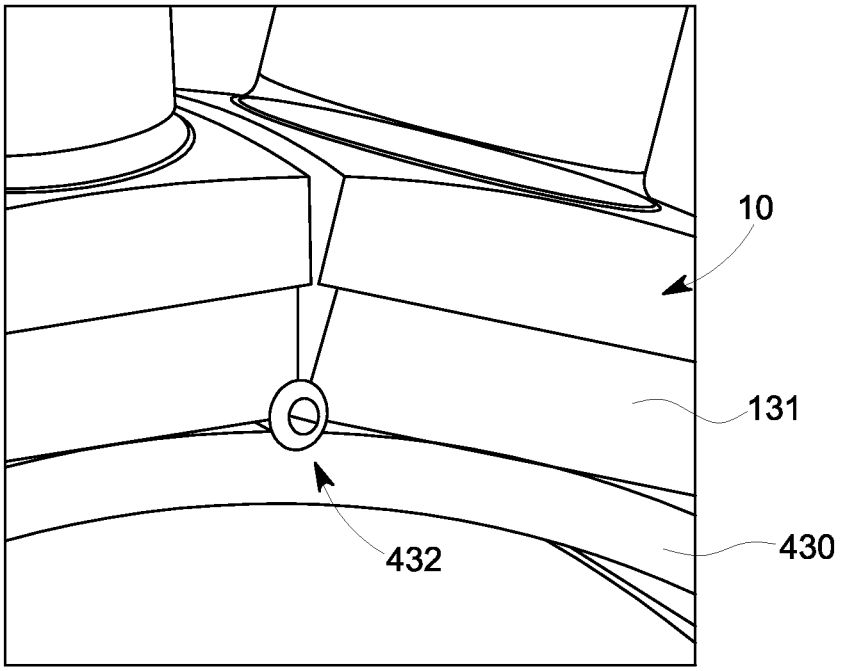
FIG. 7 is a perspective view of an alignment pin.

With reference to FIGS. 6 and 7, where the second through-holes 41 are partially pear-shaped, the attenuation bracket 10 may further include a ring 430 defining third through-holes 431 and an alignment pin 432 to align the ring 430 such that each of the third through-holes 431 is defined in positional alignment with corresponding ones of the first through-holes 31 and the second through-holes 41.

With reference to FIG. 8, an anti-rotation feature 200 may also be provided in order to prevent rotation of each individual tube 131 of the plurality of the tubes 130 about the radial dimension of each individual tube 131. In accordance with embodiments, the anti-rotation feature 200 may include a rotation restrictor that is coupled or fastened to the wheel 110 by bolts 201 and may be positioned to interfere with the rotation of at least the outer tubes 1301.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An impeller tube assembly, comprising:

an annular body having an annular attenuation arm defining first through-holes and an annular base defining second through-holes, a cross-section of the attenuation arm including a flange, a connector opposite the flange and a curvilinear section extending between the flange and the connector, a cross-section of the base including a first side corresponding with the flange where correspondence between the first side and the flange is positional correspondence defined along an axial dimension and a second side opposite the first side and corresponding with the connector where correspondence between the second side and the connector is positional correspondence defined along the axial dimension, the second side is attached with the connector such that each of the first through-holes is defined in positional alignment with a corresponding one of the second through-holes.

2. The impeller tube assembly according to claim 1, wherein the first through-holes are cylindrical and the second through-holes are frusto-conical.

3. The impeller tube assembly according to claim 1, wherein the base is formed to define an annular recess.

4. The impeller tube assembly according to claim 1, wherein the first and second through-holes are cylindrical.

5. The impeller tube assembly according to claim 1, wherein the first through-holes are cylindrical and the second through-holes are pear-shaped and include a notch defined therein within which a press fit feature is fittable.

6. An impeller tube assembly, comprising:

an annular body having an annular attenuation arm defining first through-holes and an annular base defining second through-holes, a cross-section of the attenuation arm including a flange, a connector opposite the flange and a curvilinear section extending between the flange and the connector, a cross-section of the base including a first side corresponding with the flange and a second side opposite the first side and corresponding with the connector, the second side is attached with the connector such that each of the first through-holes is defined in positional alignment with a corresponding one of the second through-holes, wherein the first through-holes are cylindrical and the second through-holes are pear-shaped, the annular body further comprising:

a freeze fit ring defining third through-holes; and an alignment pin to align the freeze fit ring such that each of the third through-holes is defined in positional alignment with corresponding ones of the first and second through-holes.

7. A turbomachine component, comprising:

a wheel rotatable about a rotor axis and having a body and opposite wheel faces thereof;

a plurality of tubes oriented in a radial dimension relative to the rotor axis and arranged in an annular array about the rotor axis; and an attenuation bracket coupled to one of the faces of the wheel to radially support the plurality of the tubes in rotational and non-rotational modes, the attenuation bracket comprising:

an annular body having an annular attenuation arm defining first through-holes and an annular base defining second through-holes, the attenuation arm being connectable with the base such that each of the first through-holes is defined in positional alignment with a corresponding one of the second through-holes, and each of the plurality of the tubes being extendable through one of the first through-holes and the corresponding one of the second through-holes.

8. The turbomachine component according to claim 7, wherein the attenuation arm extends radially outwardly and curvilinearly from the base and the attenuation bracket is coupled to the one of the wheel faces of the wheel at an inner diameter thereof and the plurality of tubes extend radially outwardly from the attenuation bracket.

9. The turbomachine component according to claim 7, further comprising an anti-rotation feature to prevent rotation of the plurality of the tubes about the radial dimension.

10. The turbomachine component according to claim 7, wherein each of the plurality of the tubes comprises:

an outer tube; and an inner tube including damping features for limiting a vibration of the outer tube.

11. The turbomachine component according to claim 10, wherein mechanical bonds connect at least one or more of the outer tube and the attenuation bracket and the inner tube and the outer tube.

12. The turbomachine component according to claim 10, wherein the inner tube and the outer tube are compressively secured to the attenuation bracket.

13. The turbomachine component according to claim 10, wherein the inner tube and the outer tube are threaded together.

14. The turbomachine component according to claim 10, wherein the inner tube and the outer tube are compressively trapped within the attenuation bracket.

15. The turbomachine component according to claim 10, further comprising a press fit ring to be press fit into the attenuation bracket to compressively trap the inner tube and the outer tube within the attenuation bracket.

16. The turbomachine component according to claim 10, further comprising:

a freeze fit ring defining third through-holes to compressively trap the inner tube and the outer tube within the attenuation bracket; and an alignment pin to align the freeze fit ring such that each of the third through-holes is defined in positional alignment with corresponding ones of the first and second through-holes.

17. A turbomachine component, comprising:

a wheel rotatable about a rotor axis and having a body and opposite wheel faces thereof;

a plurality of tubes oriented in a radial dimension relative to the rotor axis and arranged in an annular array about the rotor axis; and an attenuation bracket coupled to an inner diameter of one of the wheel faces of the wheel to radially support the plurality of the tubes in rotational and non-rotational modes, the attenuation bracket comprising:

an annular body having an annular attenuation arm defining first cylindrical through-holes and an annular base defining second frusto-conical through-holes, the attenuation arm being connectable with the base such that each of the first through-holes is defined in positional alignment with a corresponding one of the second through-holes, and each of the plurality of the tubes being mechanically bonded to the base such that retention and rotation prevention thereof is provided via friction generated between the tubes and the second through-holes and being radially, outwardly extendable through one of the first through-holes and the corresponding one of the second through-holes.

18. The turbomachine component according to claim 17, wherein a frusto-conical angle of each of the second through-holes is about 3-20 degrees, inclusively.

19. The turbomachine component according to claim 17, wherein a frusto-conical angle of each of the second through-holes is about 10 degrees.

20. The turbomachine component according to claim 17, wherein a frusto-conical angle of each of the second through-holes is about 16 degrees.

* * * * *